US006012280A

United States Patent [19]

Hufton

[11] Patent Number: 6,012,280

[45] Date of Patent: Jan. 11, 2000

[54] RECIPROCATING ENGINE

[76] Inventor: Peter F Hufton, 79 Belfield Road, Etwall, Derbyshire, United Kingdom, DE65 6JL

[21] Appl. No.: 08/866,153

[22] Filed: May 30, 1997

[30] Foreign Application Priority Data

Jun. 1, 1996 [GB] United Kingdom ..... 9611480

[51] Int. Cl.[7] ..... F02G 3/02

[52] U.S. Cl. ..... 60/39.63; 60/682; 92/153; 92/DIG. 2

[58] Field of Search ..... 60/39.6, 39.63, 60/682; 92/153, DIG. 2

[56] References Cited

U.S. PATENT DOCUMENTS

| | | | |
|---|---|---|---|
| 1,038,805 | 9/1912 | Webb | 60/682 |
| 1,326,092 | 12/1919 | Pratt | 60/682 |
| 3,826,081 | 7/1974 | Van Avermaete | 60/39.63 |
| 4,008,574 | 2/1977 | Rein | 60/682 |
| 4,179,879 | 12/1979 | Kincaid | 60/39.63 |

FOREIGN PATENT DOCUMENTS

| | | | |
|---|---|---|---|
| 703708 | 12/1979 | U.S.S.R. | 92/DIG. 2 |
| 883549 | 11/1981 | U.S.S.R. | 92/DIG. 2 |

*Primary Examiner*—Michael Koczo
*Attorney, Agent, or Firm*—W. Warren Taltavull; Farkas & Manelli PLLC

[57] ABSTRACT

A reciprocating engine (10) comprises separate cylinders (12 and 15) for air compression and expansion with heating of the compressed air taking place in a heat exchanger (17) or combustor (64) located between the cylinders (12 and 15). The flow of gas into the expander cylinder (15) is controlled by an admission valve (37). The stem (41) of the admission valve (37) extends transversely across the expander cylinder (15) and is cooled by the flow of exhaust gases out of the expander cylinder (15).

13 Claims, 4 Drawing Sheets

RECIPROCATING ENGINE

The present invention relates to a reciprocating engine and in particular to a valve configuration for a reciprocating engine operating on the Brayton or Joule cycle.

Engines operating on the Brayton or Joule cycle can be used for power generation and transportation purposes. The engines require separate cylinders for air compression and expansion with heating of the compressed air taking place in a combustor or heat exchanger located between the compressor and the expander cylinders. The combustion process is continuous and this approach produces lower emission levels than alternative reciprocating engines where the fuel is burnt intermittently. Separation of the combustion process in the Brayton or Joule cycle engine allows higher cycle temperatures and pressures to be used producing higher efficiencies.

To achieve the highest cycle temperatures and efficiencies a pressurised combustor or heat exchanger is positioned close to the admission valve in the expander section of the engine. In conventional Brayton cycle engines the stem of the hot gas admission valve passes through the working fluid at the highest temperature and pressure creating severe problems of material selection and sealing. The engine output and engine efficiency are therefore limited by metal strength considerations.

A Brayton cycle engine in accordance with the present invention is configured so that the material considerations of the stem of the admission valve is no longer a limitation. An engine in accordance with the present invention can thus operate at higher peak cycle temperature and hence cycle efficiency.

According to the present invention a reciprocating engine comprises a compressor section which includes a cylinder in which a piston reciprocates and which receives air for compression by the reciprocating piston, a heating section which receives air from the compressor and an expander section including a further cylinder in which a further piston reciprocates and which receives the heated air from the heating section of the engine, valve means being provided to control the flow of air and exhaust gases into the respective sections of the engine characterised in that the valve which permits the flow of gases into the expander section is operated by control means which extend through the expander cylinder so that in operation the control means are cooled by the exhaust gases passing out of the expander.

In the preferred embodiment of the present invention the valve control means is a stem which extends transversely across the expander cylinder. The stem is preferably actuated by a cam mechanism located externally of the expander cylinder.

The present invention will now be described with reference to the accompanying drawings.

Figure 1:
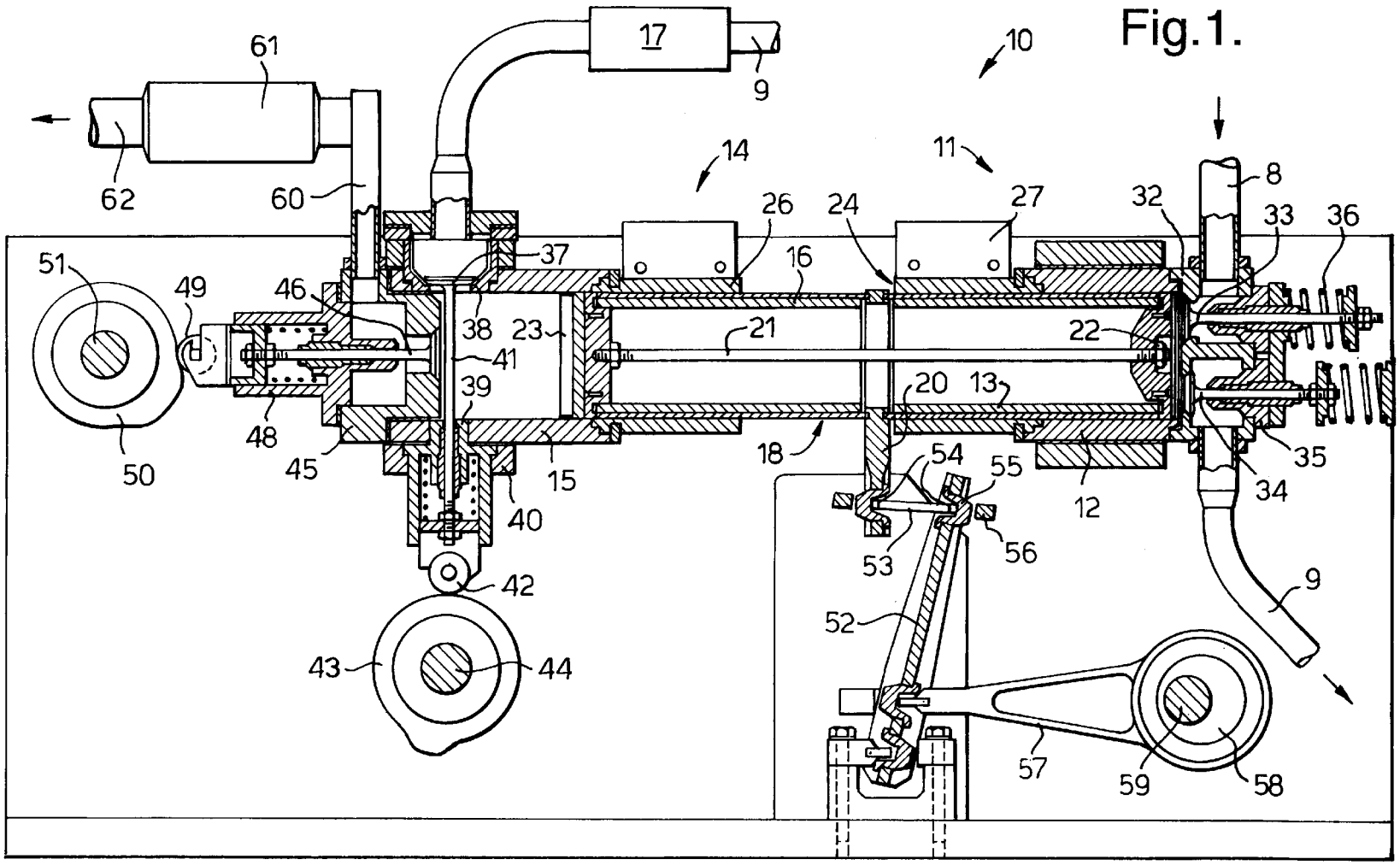
FIG. 1 is a cross-sectional view of a Brayton cycle engine in accordance with the present invention.

Referring to FIG. 1 a Brayton cycle engine 10 has a compressor section 11 and an expander section 14 with a heat exchanger 17 located between the compressor 11 and expander 14 sections. The compressor section 11 has a cylinder 12 which is axially opposed to a cylinder 15 in the expander section 14. A common axially reciprocating piston assembly 18 slides in the cylinders 12 and 15.

The piston assembly 18 comprises a compressor piston 13 and an expander piston 16. The pistons 13 and 16 are hollow shells which are located in a drive plate 20 and held in contact by a central bolt 21 acting through a disc spring 22. A ceramic cap 23 protects the end of the expander piston 16 which in operation is exposed to high temperatures.

Figure 2:
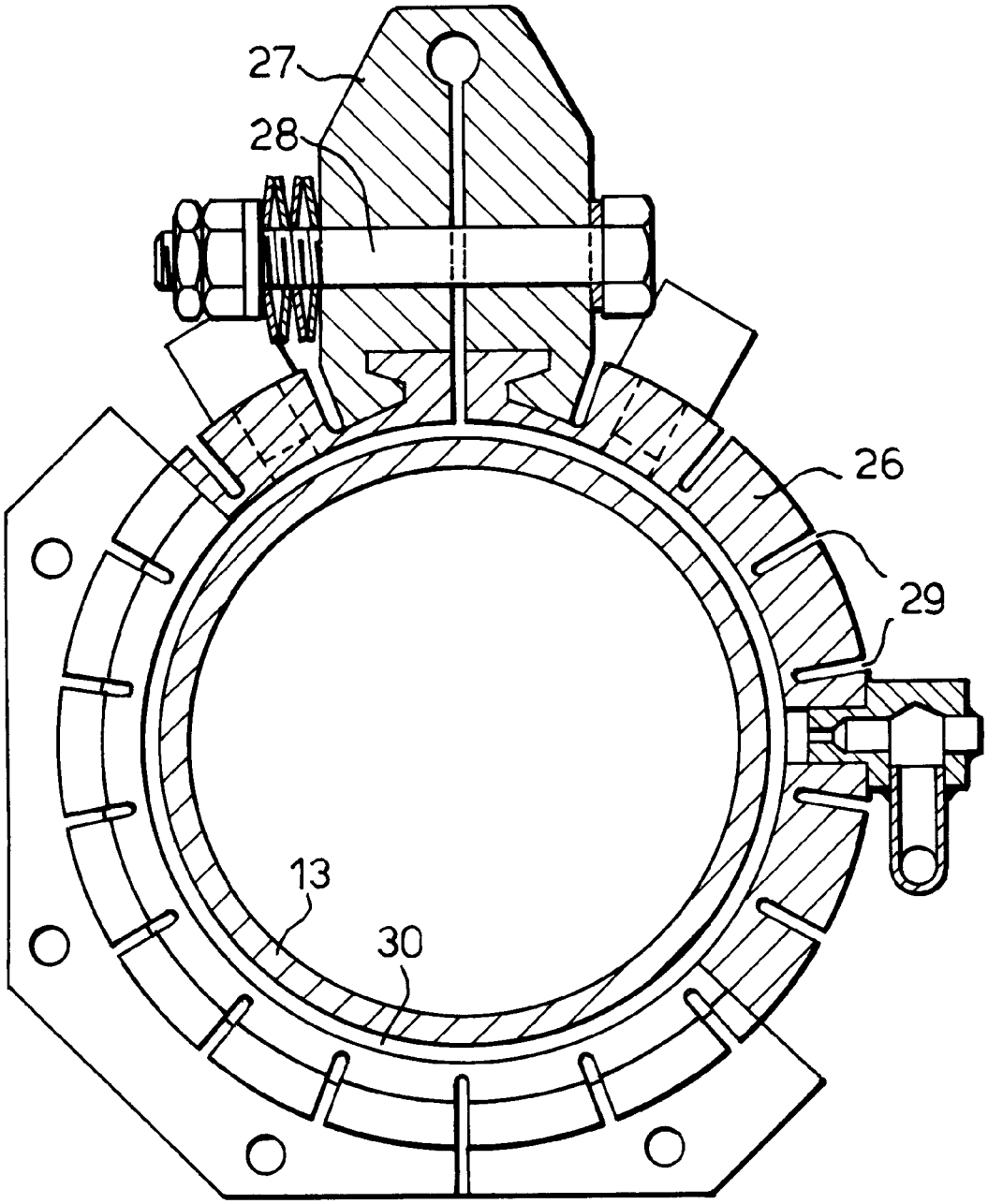
FIG. 2 is an enlarged part sectional view of an air bearing for use in a Brayton cycle engine shown in FIG. 1.

The piston assembly 18 slides in air bearings 24. The air bearings 24 are located by clamp plates 27 to the compressor and expander cylinders 12 and 15 respectively. The bearing shells 26, FIG. 2, conform closely to the pistons 13 and 16 by virtue of clamp plates 27 and spring loaded bolts 28. The bearing shells 26 are flexible radially but stiff axially by virtue of grooves 29. The flexibility of the bearing shells 26 allow them to automatically compensate for differential expansion between the bearing shells 26 and pistons 13 and 16. In operation air is passed into the annular gap 30 between the bearing shells 26 and the pistons 13 and 16 to allow reciprocating movement of the pistons 13 and 16 within the cylinders 12 and 15. The quantity of air used in minimized by running with small clearances between the bearing shells 26 and the pistons 13 and 16. The advantage of using air bearings 24 is that piston friction is extremely low and the need for oil based lubrication is eliminated so that the pistons 13 and 16 and cylinders 12 and 15 need not be cooled. The small operating clearances of the air bearings 24 also act as a piston seal as the small amount of lubricating air leaking into the cylinders 12 and 15 prevents gases leaking out.

A valve head 32 is located in the compressor cylinder 12. The valve head 32 houses an inlet valve 33 and an outlet valve 34 which pass through valve guides 35 and are closed by valve springs 36. The valve springs 36 act so that the valve 33 allows air to enter the cylinder 12 while valve 34 allows compressed air to leave the cylinder 12.

An admission valve housing 38 and valve guide 39 are located in the expander cylinder 15 by clamps 40. The stem 41 of an admission valve 37 passes across the expander cylinder 15. The admission valve 37 is operated by a cam follower 42 controlled via a cam 43 following cam shaft 44.

An exhaust valve head 45 is also located in the expander cylinder 15. Exhaust valve 46 passes through a valve guide 48 and is operated by a cam follower 49 controlled via a cam 50 following cam shaft 51.

Reciprocating movement of the piston assembly 18 is converted to rotary motion via a connection to the drive plate 20 in which the pistons 13 and 16 are located. The drive plate 20 is connected to a lever 52 by link 53 located by knife edges 54 and housings 55 which are held in place by clamps 56. The lever 52 drives through connecting rod 57 and eccentric 58 to the drive shaft 59. The lever 52 with knife edge pivots 54 is used to transmit movement of the piston assembly 18 to the drive shaft 59 through an eccentric 58. This is a low friction method which can operate in a hot environment without lubrication.

The drive shaft 59 is connected to the cam shafts 44 and 51 by a belt drive (not shown) so that the valves 37 and 46 are operated by the reciprocating movement of the piston assembly 18.

To commence operation the engine 10 is turned over by rotating the drive shaft 59. The belt drive (not shown) which connects the drive shaft 59 to camshaft 44 causes rotation of the camshaft 44 which in turn opens the admission valve 37 in the expander. Compressed air is admitted from a storage reservoir (not shown) into the expander cylinder 15. The compressed air expands moving the piston assembly 18 to the right to compress air in the compressor section 11. A combination of inertia and residual compressed air charge pushes the piston assembly 18 in reverse at the same time operating the expander outlet valve 46 to allow the expanded air to be exhausted. The expander exhaust valve 46 closes and the admission valve 37 opens admitting a further compressed air charge which has been heated by the heat exchanger 17. The air charge expands and repeats the process.

During the exhaust stroke the compressor inlet valve 33 opens and allows air into the compressor cylinder 12. Valve 33 closes on the reverse stroke and outlet valve 34 opens when the pressure in the cylinder 12 exceeds the pressure in the exit pipe 9.

Once in operation air enters the compressor valve head 32 through inlet pipe 8 having an air filter (not shown). The air is compressed by the reciprocating piston assembly 18 and leaves the compressor section 11 through the pipe 9. Pipe 9 feeds the compressed air to a heat exchanger 17. The compressed air is heated on passing through the heat exchanger 17 and fed into the valve housing 38 in the cylinder 15 of the expander section 14. The valve housing 38 is lined with refractory material and the admission valve 37 is opened to allow the heated compressor air into the expander 14. The admission valve 37 is opened by cam follower 42 which is operated by rotation of cam 43 via camshaft 44 and is returned by a spring.

The compressed air expands driving the piston 16 which in turn drives piston 13 to compress air admitted to the compressor section 11 of the engine 10.

Exhaust valve 46 located in the end of the expander cylinder 15 is opened by cam follower 49 which is operated by rotation of the cam 50 via camshaft 51. The exhaust gas leaves the valve head 45 by a connecting pipe 60 and passes through a silencer 61 and exhaust pipe 62.

Figure 3:
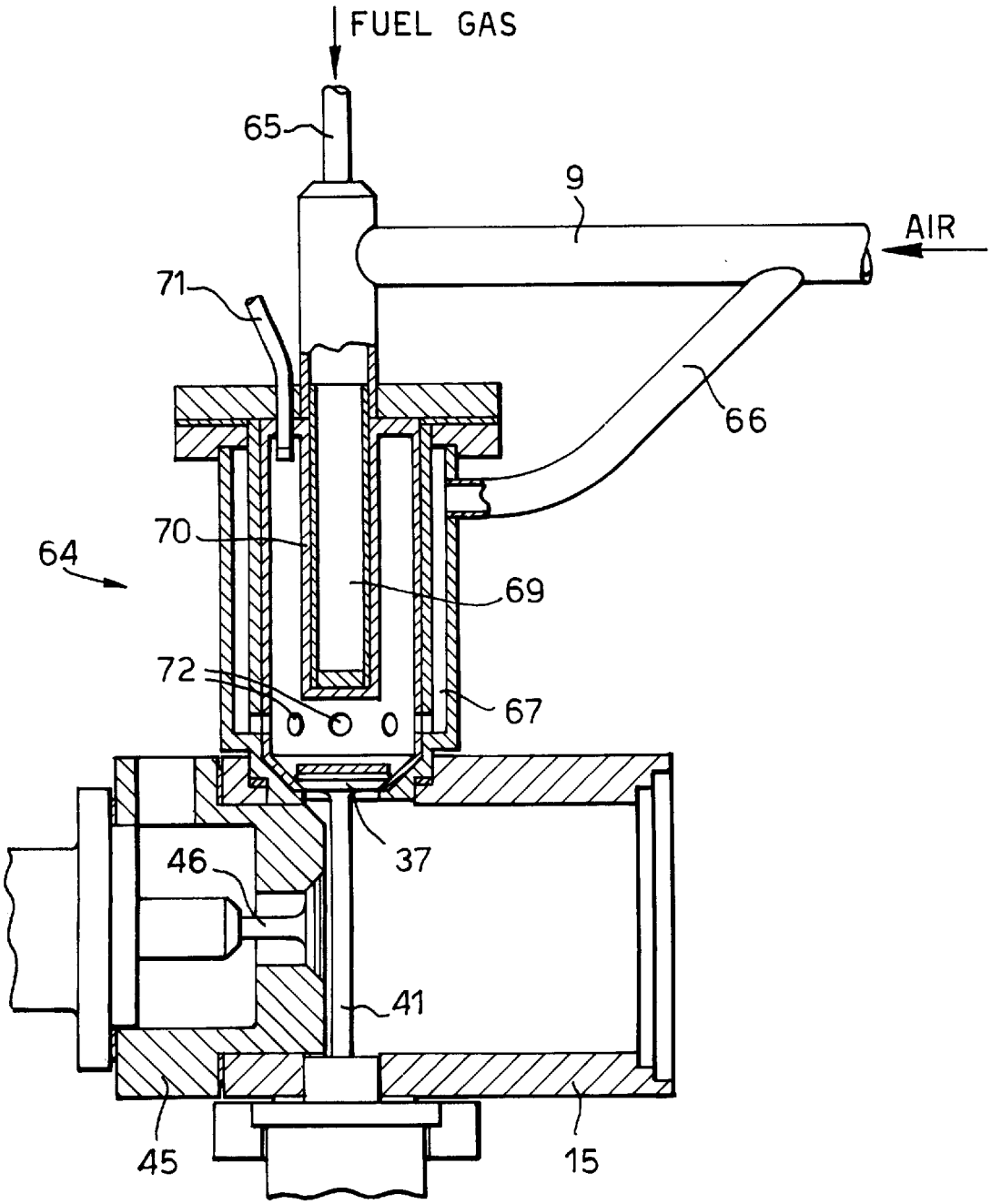
FIG. 3 is a part sectional view of a combustor for use in a Brayton cycle engine in accordance with the present invention.

Although the invention has been described with reference to a heat exchanger 17 a combustor can be used instead. To achieve the highest cycle temperature and efficiencies a pressurised combustor 64, shown in FIG. 3 is placed close to the expander cylinder 15. Pipe 9 brings air from the compressor 11 to the combustor 64. Fuel flows through pipe 65 to form a premixed combustible mixture with the air 9. Air not required for combustion flows through the bypass pipe 66 into an annular space 67 around the burner. The combustor 64 is cooled by the bypass air and is lined with insulating material to control metal temperatures and reduce heat losses. The mixture flows through perforated pipe 69 and through the refractory insulation layer 70 where it burns on the surface having been ignited by igniter 71. Hot gas from the combustion process flows down the insulated annulus to holes 72 which admit bypass air to mix with the combustion products and reduce the temperature. The combustion gases then pass into the expander cylinder 15 through the expander admission valve 37. The crown of the expander admission valve 37 is protected with refractory material.

The admission valve 37 controls the flow of gases into the expander cylinder 15. The admission valve 37 opens and closes a gas port at the upstream end of the expander cylinder 15. The admission valve stem 41 extends transversely across the expander cylinder so that it does not have to pass through the high temperature gases contained in the pressurised combustor 64 and where it is cooled by the flow of exhaust gases out of the expander cylinder 15 though the expander exhaust valve 46. Operation of the admission valve is controlled by the cam mechanism 42, 43 and 44 located externally of the expander cylinder 15.

Figure 4:
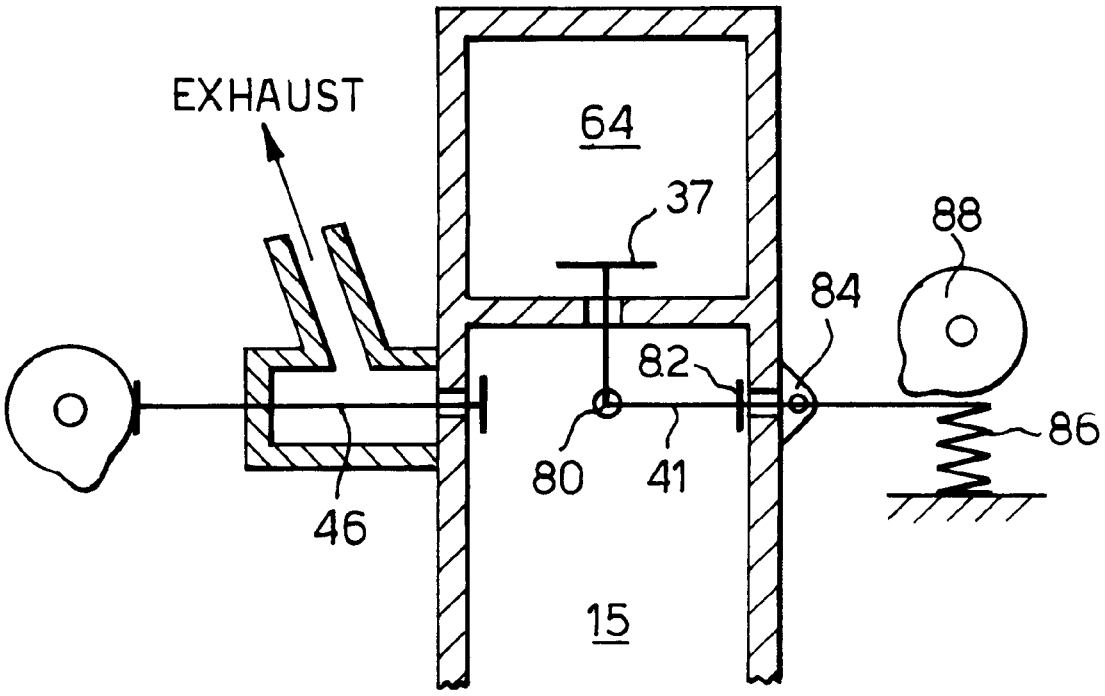
FIG. 4 is an enlarged cross-sectional view of a valve configuration in accordance a further embodiment of the present invention.

In the preferred embodiment of the present invention, shown in FIG. 1, the stem 41 of the exhaust valve 37 passes through both side walls of the expander cylinder 15 so that the majority of its length is cooled by the exhaust gases. However it will be appreciated by one skilled in the art that the valve stem 41 could be configured as shown in FIG. 4. In this arrangement the valve stem 41 is hinged at 80. A portion of the valve stem 41 extends transversely to the expander cylinder 15 and passes through a seal 82 to pivot 84 and on to return spring 86 and actuating cam 88. A valve stem 41 configured in accordance with FIG. 4 still benefits from the advantage that the valve stem is cooled by the outward flow of exhaust gases.

I claim:

1. A reciprocating engine comprising a compressor section which includes a cylinder in which a piston reciprocates and which receives air for compression by the reciprocating piston, a heating section which receives air from the compressor section and an expander section including a further cylinder in which a further piston reciprocates and which receives the heated air from the heating section of the engine, valves being provided to control the flow of air and exhaust gases into the respective sections of the engine, the valve which permits the flow of exhaust gases out from the expander section being located at the top end of the expander cylinder, the valve which permits the flow of gases into the expander section being operated by control means, the control means extend through the expander cylinder transverse to the axis of the expander cylinder and to the flow of exhaust gases so that in operation the control means are cooled by the exhaust gases passing out of the expander section.

2. A reciprocating engine as claimed in claim 1 in which the control means is a valve stem which extends transversely across the expander cylinder.

3. A reciprocating engine as claimed in claim 1 in which the control means extends through both side walls of the expander cylinder.

4. A reciprocating engine as claimed in claim 1 in which the control means extends through one of the side walls of the expander cylinder.

5. A reciprocating engine as claimed in claim 1 in which the control means is actuated by a cam mechanism located externally of the expander cylinder.

6. A reciprocating engine as claimed in claim 1 in which the compressor and expander sections are axially opposed.

7. A reciprocating engine as claimed in claim 6 characterised in that the compressor and expander pistons are interconnected to form a common piston assembly which reciprocates in the axially opposed compressor and expander sections.

8. A reciprocating engine as claimed in claim 1 in which the heating section of the engine is a heat exchanger.

9. A reciprocating engine as claimed in claims 1 in which the heating section is a combustor which receives air from the compressor and receives fuel to be mixed with said compressed air for continuous combustion therein.

10. A reciprocating engine as claimed in claim 1 in which the reciprocating motion of the pistons is converted to rotary motion to rotate a drive shaft.

11. A reciprocating engine as claimed in claim 10 in which the reciprocating motion is converted to rotary motion via levers located on knife edges and an eccentric.

12. A reciprocating engine as claimed in claim 1 in which air bearings are used to facilitate reciprocating movement of the piston assembly in the cylinders.

13. A reciprocating engine as claimed in claim 12 in which the air bearings are provided with a resilient bearing shell to facilitate automatic compensation for differential expansion between the piston assembly and the bearing shells.

* * * * *